US005171925A

United States Patent [19]

Mekler

[11] Patent Number: 5,171,925

[45] Date of Patent: Dec. 15, 1992

[54] GUN BARREL CLEANING TOOL

[76] Inventor: Dan Mekler, P.O. Box 53177, Jerusalem 53177, Israel

[21] Appl. No.: 588,285

[22] Filed: Sep. 26, 1990

[30] Foreign Application Priority Data

Sep. 27, 1989 [IL] Israel ..... 91808

[51] Int. Cl.[5] ..... F41A 29/02

[52] U.S. Cl. ..... 42/95; 15/104.165; 264/275

[58] Field of Search ..... 15/104.16, 104.165, 15/104.2; 42/90, 95, 96; 264/275; 403/212, 265, 267, 269

[56] References Cited

U.S. PATENT DOCUMENTS

| | | | |
|---|---|---|---|
| 621,857 | 3/1899 | Scott | 42/95 |
| 1,061,119 | 5/1913 | P'Pool | 15/104.165 |
| 3,301,931 | 1/1967 | Morin | 264/275 |
| 3,512,223 | 5/1970 | Willinger | 403/269 |
| 4,010,565 | 3/1977 | DiProspero | 42/96 |

FOREIGN PATENT DOCUMENTS

| | | | |
|---|---|---|---|
| 383520 | 10/1923 | Fed. Rep. of Germany | 15/104.165 |
| 410549 | 3/1966 | Switzerland | 403/212 |
| 119125 | 9/1918 | United Kingdom | 15/104.20 |

OTHER PUBLICATIONS

Barnhart, C. L., The American College Dictionary, "cord", p. 268, 1969.

U.S. General, "Spring/Summer 1988 Tool Book", p. 165.

*Primary Examiner*—Stephen C. Bentley

*Attorney, Agent, or Firm*—Benoit Law Corporation

[57] ABSTRACT

A pull-through for cleaning fire-arm barrels. The pull-through is generally comprised of multifilament synthetic fiber line, and has a cleaning cloth loop at one end and a weight at the other end. The loop is formed by twisting the free end of the line about an intermediate portion thereof to form a convoluted section. The convoluted section is embedded within a solid body of a moldable, usually plastic, material. A method for producing the pull-through is also disclosed.

20 Claims, 2 Drawing Sheets

GUN BARREL CLEANING TOOL

BACKGROUD OF THE INVENTION

The present invention relates to pull-throughs for cleaning fire arm barrels.

Pull-throughs are conventionally known as being made of a canvas or linen line comprising a tubular weight connected at one free end of the line, and a loop formed at its other end, the length of the line somewhat exceeding that of the barrel for which it is designed to clean. Flannel cloth for cleaning fire-arms, usually having a series of markings along which the cloth is to be cut, is available. The piece of cloth is inserted into the loop, the weight is threaded at one end of the barrel through which it is passed until it emerges from the opposite end thereof. The line is then pulled so that the cloth is forcibly passed through the barrel, cleaning the inside thereof.

With the recent trend toward using smaller caliber rifles and sub-machine guns, of 6 mm and less (usually 5.56 mm), it has been found that the conventional linen threaded pull-through cord could no longer be used. Since the loop was made by backsplicing the free end of the line to an intermediate portion thereof, the result was a thickened, elongated, relatively small diameter knot-although not small enough for the purposes in question.

From another aspect, the force to which the pull-through may be subject sometimes can be as high as 40 Kg or more, depending on the internal condition of the barrel and the amount of cloth used.

This situation has lead to the design of alternatives incorporating line comprised of different materials, as well as techniques for producing the loop.

There have thus been attempts to use synthetic lines or steel wires, connected by metal clamps of various designs. However, these proposals have failed for various reasons, including the inconvenience arising from rigidity of the wire, insufficient clamping force, and potential damage resulting from the metal clamp and/or wire scratching of the internal surface of the rifle barrel.

SUMMARY OF INVENTION

It is thus the object of the invention to overcome the defficiencies of conventional pull-throughs.

It is a further object of the invention to use synthetic lines with a durable loop having high tencity resisting capacity and formed by a knot of minimum diameter.

It is a still further object of the invention to provide a pull-through with a non-metal clamp for the loop forming knot.

Thus according to the invention, there is provided a pull-through for cleaning fire-arm barrels, including a line of multiple woven filaments having a cleaning cloth loop at one end and a weight at the other end thereof, the loop being formed by twisting about each other the free end, and an intermediate portion of the line into an elongated, convoluted section, the section being embedded within a solid body of a moldable material. This entire embedded convoluted section is knot-free.

The moldable material is preferably plastic, the solid body being formed by injection molding.

The line is preferably made of multifilament woven synthetic fibers, for example line sold under the name "NYLON 6/6" or "LEOLENE", or other similar line.

It should be noted that solid or homogenous synthetic lines, such as monofilament fishing line, could have sufficient tencile strength for the purposes in question, however, a number of drawbacks rule out their use, including their rigidity, as well as their smooth and slippery outer surface which prohibits the adherence of an outer coating-in this case the encapsulating body. Therefore only woven multifilament lines of the type noted above are readily applicable for use in the context of the present invention.

The embedding of the convoluted section within the plastic body assures that the twisted line sections will not become unwound, but does not contribute to nor play a role in the mechanical resistance against the pulling forces to which the line is subjected. As will be explained in more detail below, as the pulling forces increase, the section tightens onto itself; thus the forces are not applied outwardly to the solid body.

For better understanding of the constructional features and advantages of the invention, reference shall be made to the following description of a preferred embodiment of the invention, given by way of example only, with reference to the accompanying drawings.

BRIEF DESCRIPTION OF THE DRAWINGS

FIG. 4 shows the construction of the weight associated with the pull-through.

DETAILED DESCRIPTION OF THE PREFERRED EMBODIMENT

Figure 1:
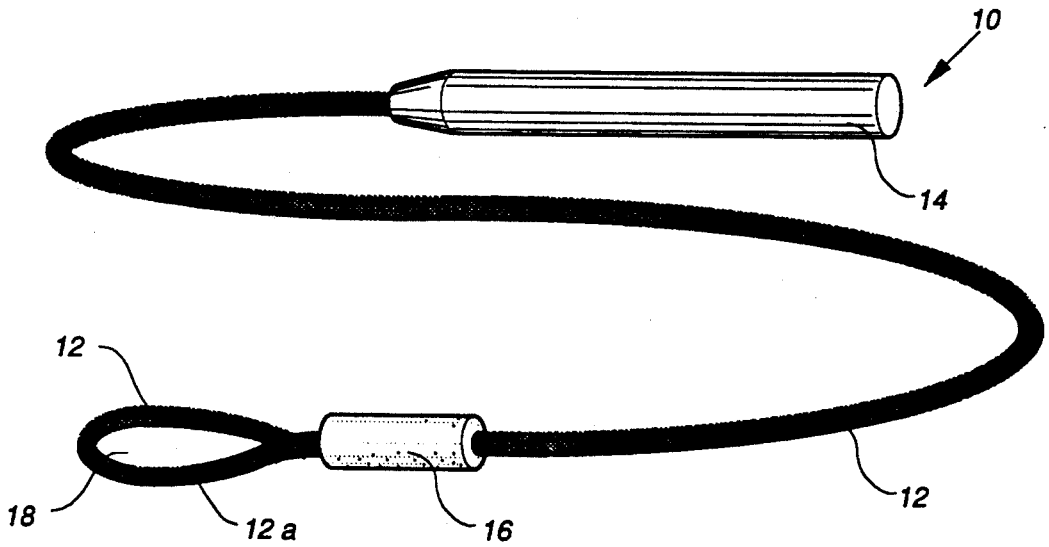
FIG. 1 is a general view of a pull-through embodying the features of the present invention.

As seen in FIG. 1, the pull-through generally denoted 10, comprises a length of line 12 to which there are attached weight 14 at one side, and a solid body 16, forming loop 18. In use, a piece of cloth 32 is inserted into loop 18 is to clean the gun barrel when the pull-through is dragged therethrough.

Figure 2:
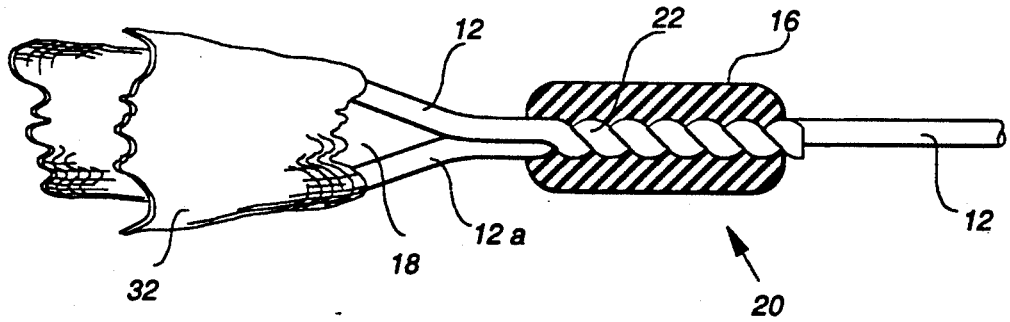
FIG. 2 is a cross section of the twisted line within the convoluted section, forming the loop of the pull-through line of FIG. 1.
Figure 3A:
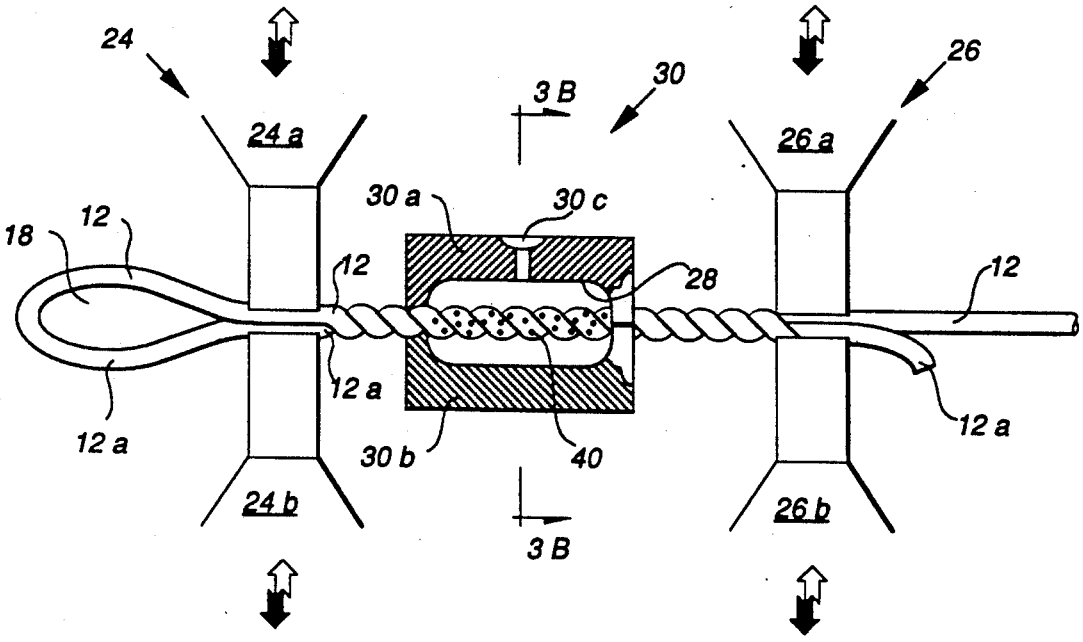
FIG. 3*a* illustrates a mold for producing the convoluted section encapsulating body by plastic injection method.

As better seen in FIG. 2 the body 16 encapsulates a convoluted section 22 of the line 12, which consists of the free end of the line, folded back to form the loop 18, the two parallel line lengths being twisted together. As seen in FIGS. 2 and 3*a* the section 22 is knot-free.

In practice, if 2 mm line is used, a threading comprised of about ten convolutions will generally have sufficient strength against slipping of the loop during extensive, prolonged use.

Figure 3B:
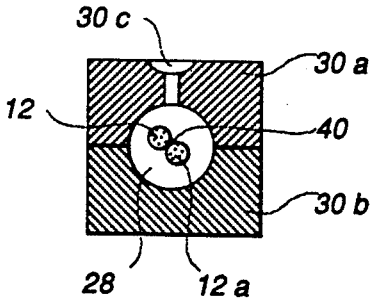
FIG. 3*b* is a section along line A—A of FIG. 3*a*.

The body 16 is most conveniently produced by the equipment schematically shown in FIGS. 3*a* and 3*b*. Hence, a loop 18 is made at the end of line 12 by folding back section 12*a*. The resulting pair of line sections 12 and 12*a*, are clamped between jaws 24*a* and 24*b* of a first vice device 24. A similar vice device 26 is provided for clamping the remaining section of line sections 12 and 12*a* by jaws 26*a* and 26*b*.

The knot-free convoluted section 22 is formed by twisting line sections 12 and 12*a* about each other, and is situated in a cavity 28 of plastic injection mold halves 30*a* and 30*b*. Twisting of the line sections is preferably effected by coaxially rotating either of vice devices 24 or 26 with respect to the other. The mold 30 is provided with ain injection nozzle 30*c*.

While the line is clamped in its convoluted position, plastic is injected into the mold, thereby encapsulating the convoluted section 22 within the solid body 16. Upon solidification of the plastic material, e.g. polypropylene, the mold 30 is opened and the vice clamping devices 24 and 26 are released. The line sections 12 and 12*a* which are then not encapsulated within the body 16, are then free to unravel, and the excess section of line 12*a* is removed.

Obviously, the body 16 may be alternatively cold formed, using various types of resinous or cementing materials.

As already noted, the body 16 does not require substantial mechanical strength, since it does not take part in resisting the pulling force applied to the line 12, but rather prevents unwinding of the convoluted section 22. As a measure to obtain additional strength adhesive 40 may be applied to the line sections 12 and 12*a* prior to injection of plastic into the mold 30. Particularly suitable as adhesive would be anerobic cynoacrylate adhesives glue, sold under the tradenames "LOCKTITE 3194" or "LOCKTITE 3954".

Figure 4:
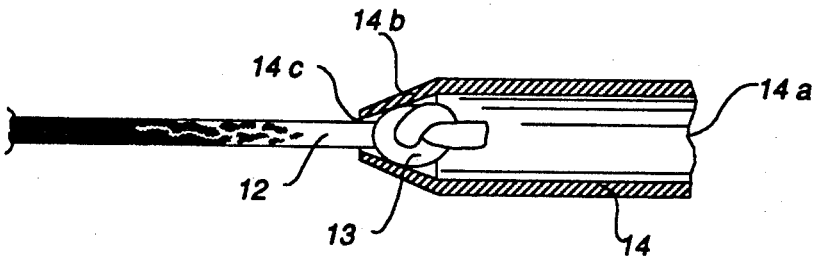

As seen in FIG. 4, the weight 14 is in the form of a tube, having one open side 14*a* and a convergent section 14*b* defining a smaller diameter opening 14*c*. Thus, a conical section is formed into which the other, free end of the line 12 can be inserted. A knot 13 is formed in the end of line 12 and jammed into the conical section 14*b* to provide a highly secured fastening of the line to the weight 14.

Many other, conventional solutions and arrangements are applicable.

Those skilled in the art will readily appreciate the contribution of the present invention in providing a simple, low-cost and effective solution to the problem of manufacturing pull-throughs for small caliber fire arms. The method of producing the pull-throughs does not involve assembly of extraneous or auxiliary parts and components, or devices for applying same, and is therefore readily adaptable for automated mass production.

Various changes, modifications and variations of the invention will be apparent.

What is claimed is:

1. A pull-through for cleaning fire-arm barrels, including a line of multiple woven filaments having a cleaning cloth loop at one end and a weight at the other end thereof, the loop being formed by twisting about each other the free end, and an intermediate portion of the line into an elongated, convoluted section, the section being embedded within a solid body of a moldable material, the entire embedded convoluted section being knot-free.

2. The pull-through as claimed in claim 1 wherein the moldable material is plastic, the solid body being formed by injection molding.

3. The pull-through as claimed in claim 2 wherein the line is comprised of synthetic fibers.

4. The pull-through as claimed in claim 3 wherein the line of multiple woven filaments is a line sold under the tradename "NYLON 6/6".

5. The pull-through as claimed in claim 3 wherein the line of multiple woven filaments is a line sold under the tradename "LEOLENE".

6. The pull-through as claimed in claim 1 wherein the moldable material is a solidified plastic material.

7. The pull-through as claimed in claim 3 wherein the moldable material is a solidified plastic material.

8. The pull-through as claimed in claim 4 wherein the moldable material is a solidified plastic material.

9. The pull-through as claimed in claim 5 wherein the moldable material is a solidified plastic material.

10. The pull-through as claimed in claim 1 including an adhesive applied to the line forming the convoluted section.

11. The pull-through as claimed in claim 10 wherein the adhesive is anerobic cynoacrylate glue.

12. The pull-through as claimed in claim 10 wherein the moldable material is a solidified plastic material.

13. The pull-through as claimed in claim 2 including an adhesive applied to the line forming the convoluted section.

14. The pull-through as claimed in claim 13 wherein the moldable material is a solidified plastic material.

15. The pull-through as claimed in claim 3 including an adhesive applied to the line forming the convoluted section.

16. The pull-through as claimed in claim 15 wherein the moldable material is a solidified plastic material.

17. The pull-through as claimed in claim 4 including an adhesive applied to the line forming the convoluted section.

18. the pull-through as claimed in claim 17 wherein the moldable material is a solidified plastic material.

19. The pull-through as claimed in claim 5 including an adhesive applied to the line forming the convoluted section.

20. The pull-through as claimed in claim 19 wherein the moldable material is a solidified plastic material.

* * * * *